US010987271B2

(12) United States Patent
Xiong et al.

(10) Patent No.: US 10,987,271 B2
(45) Date of Patent: Apr. 27, 2021

(54) UPPER LIMB EXOSKELETON REHABILITATION DEVICE WITH MAN-MACHINE MOTION MATCHING AND SIDE-TO- SIDE INTERCHANGING

(71) Applicant: Huazhong University of Science and Technology, Hubei (CN)

(72) Inventors: Caihua Xiong, Hubei (CN); Xuan Wu, Hubei (CN); Chang He, Hubei (CN); Jianbo Tao, Hubei (CN); Chenbo Wang, Hubei (CN); Wenbin Chen, Hubei (CN)

(73) Assignee: HUAZHONG UNIVERSITY OF SCIENCE AND TECHNOLOGY, Hubei (CN)

( * ) Notice: Subject to any disclaimer, the term of this patent is extended or adjusted under 35 U.S.C. 154(b) by 273 days.

(21) Appl. No.: 16/172,038

(22) Filed: Oct. 26, 2018

(65) Prior Publication Data

US 2020/0000671 A1 Jan. 2, 2020

(30) Foreign Application Priority Data

Jun. 29, 2018 (CN) ..... 2018107171080.0

(51) Int. Cl.
*A61H 1/02* (2006.01)
*A63B 21/00* (2006.01)
*A63B 22/00* (2006.01)

(52) U.S. Cl.
CPC ..... *A61H 1/0281* (2013.01); *A61H 1/0277* (2013.01); *A63B 21/00181* (2013.01);
(Continued)

(58) Field of Classification Search
CPC ..... A61H 1/02; A61H 1/0274; A61H 1/0277; A61H 1/0281; A61H 1/0285
See application file for complete search history.

(56) References Cited

U.S. PATENT DOCUMENTS 5,085,556 A * 2/1992 Ohtomi ..... B25J 9/023 414/744.3
5,211,617 A * 5/1993 Millen ..... A63B 21/0455 482/127

(Continued)

FOREIGN PATENT DOCUMENTS

CN 102499857 A 6/2012
CN 103070756 A 5/2013
CN 104473752 B 7/2015

*Primary Examiner* — Tu A Vo
*Assistant Examiner* — Christopher E Miller
(74) *Attorney, Agent, or Firm* — Hamre, Schumann, Mueller & Larson, P.C.

(57) ABSTRACT

An upper limb exoskeleton rehabilitation device having man-machine motion matching and side-to-side interchanging, includes a chassis bracket assembly, a shoulder girdle abduction assembly, a side-to-side interchanging assembly and a mechanical arm coupling member. The chassis bracket assembly includes a frame and a lifting unit mounted on the frame. The shoulder girdle abduction assembly is mounted on the lifting unit to be driven by the lifting unit to move up and down. The side-to-side interchanging assembly is rotatably connected to the shoulder girdle abduction assembly and the mechanical arm coupling member, and the mechanical arm coupling member is configured to mount the mechanical arm and drive the mechanical arm to rotate with the respective rotating joints. Through an upper locking assembly and a lower locking assembly mounted on the side-to-side interchanging assembly, the side-to-side interchanging assembly is fixed or rotated relative to the shoulder girdle abduction assembly and the mechanical arm coupling member.

5 Claims, 8 Drawing Sheets

(52) U.S. Cl.
CPC ..... *A63B 21/4035* (2015.10); *A63B 22/0005* (2015.10); *A61H 2201/1635* (2013.01); *A61H 2201/1673* (2013.01); *A63B 2022/0094* (2013.01)

(56) References Cited

U.S. PATENT DOCUMENTS 5,811,951 A * 9/1998 Young ..... B25J 9/042 318/568.1
6,301,526 B1 * 10/2001 Kim ..... B25J 9/0006 600/1
9,375,598 B1 * 6/2016 Lai ..... A61H 1/0274
10,736,809 B2 * 8/2020 Cempini ..... A61H 1/0281
2003/0115954 A1 * 6/2003 Zemlyakov ..... A63B 21/4019 73/379.01
2008/0009771 A1 * 1/2008 Perry ..... B25J 9/0006 600/587
2009/0149783 A1 * 6/2009 Nef ..... A63B 23/03508 601/5
2009/0281465 A1 * 11/2009 Fu ..... A61H 1/0274 601/5
2010/0016766 A1 * 1/2010 Zhang ..... A61H 1/0281 601/5
2010/0160986 A1 * 6/2010 Simmons ..... A61H 1/0274 607/3
2011/0251533 A1 * 10/2011 Han ..... A61H 1/0274 601/33
2012/0088641 A1 * 4/2012 Shah ..... A63B 21/00072 482/110
2012/0172769 A1 * 7/2012 Garrec ..... A61F 5/013 601/33
2012/0328395 A1 * 12/2012 Jacobsen ..... B25J 3/04 414/1
2012/0330198 A1 * 12/2012 Patoglu ..... B25J 9/0003 601/33
2013/0060171 A1 * 3/2013 Fu ..... A61H 1/02 601/5
2013/0158438 A1 * 6/2013 Scott ..... A61H 1/0237 600/595
2013/0237883 A1 * 9/2013 Malosio ..... A61H 1/0274 601/33
2014/0336542 A1 * 11/2014 Fu ..... A61H 1/0277 601/5
2015/0360069 A1 * 12/2015 Marti ..... A63B 23/03508 482/6
2016/0000633 A1 * 1/2016 An ..... A61H 1/0277 601/33
2017/0100295 A1 * 4/2017 Bonutti ..... A61F 5/013
2017/0173783 A1 * 6/2017 Angold ..... B25J 9/109
2017/0189257 A1 * 7/2017 Lan ..... A63B 21/4017
2018/0071163 A1 * 3/2018 Cempini ..... A61H 1/0281
2018/0289577 A1 * 10/2018 Danieli ..... A61H 1/0255
2019/0201273 A1 * 7/2019 Soltani-Zarrin ..... A61H 1/0274
2019/0269571 A1 * 9/2019 Park ..... A61H 1/0281
2019/0290527 A1 * 9/2019 Liu ..... A61H 1/02
2019/0321986 A1 * 10/2019 Xiong ..... B25J 19/0016
2020/0129365 A1 * 4/2020 Park ..... B25J 9/0006
2020/0155406 A1 * 5/2020 Baldoni ..... A61H 1/0281

* cited by examiner

UPPER LIMB EXOSKELETON REHABILITATION DEVICE WITH MAN-MACHINE MOTION MATCHING AND SIDE-TO- SIDE INTERCHANGING

BACKGROUND OF THE INVENTION

Technical Field

The present invention belongs to the technical field of medical rehabilitation training equipment, and more particularly relates to an upper limb exoskeleton rehabilitation device with man-machine motion matching and side-to-side interchanging.

Description of the Related Art

China is entering an aging society, and in the elderly population, there are a large number of patients with limb motor dysfunction caused by cardiovascular and cerebrovascular diseases represented by strokes as well as accidents. The demand for rehabilitation therapy is increasing in this part of the population, and thus, seeking an efficient and safe rehabilitation treatment has become an urgent problem and test in the field of rehabilitation therapy in China.

For patients with hemiplegia, the conventional rehabilitation is generally performed by long-term one-on-one training of a rehabilitation physician on the patient, or using a single-function medical device. This repetitive training has low efficiency and high labor cost, and it is difficult to control the intensity of the training.

As one of the important components of the human body, the upper limb is connected to the chest and neck, and includes a shoulder, an upper arm, an elbow, a lower arm and a hand. The coordinated motion of the whole upper limb is controlled by the shoulder joint, the elbow joint and the wrist joint. Most of the daily needs of human beings need to be realized through motions of the upper limbs, and thus, it is particularly important for the development and production of upper limb rehabilitation devices.

In order to solve the above problems, many universities and enterprises have developed rehabilitation training devices for upper limb motor dysfunction. Chinese Patent Publication No. 102499857 discloses a portable upper limb exoskeleton rehabilitation device for treating upper limb motor dysfunction, and the rehabilitation device has five degrees of freedom besides the degrees of freedom of the hand, which are respectively two degrees of freedom of the shoulder joint, two degrees of freedom of the elbow joint and one degree of freedom of the wrist joint. Chinese Patent Application Publication No. 104473752 discloses an upper limb rehabilitation training device based on grouping coupling driving. This upper limb rehabilitation training device has two active degrees of freedom and five passive degrees of freedom, and three of the five passive degrees of freedom are provided at the shoulder joint to adapt to the motion of the shoulder joint in space. Chinese Patent Application Publication No. 103070756 discloses an upper limb exoskeleton rehabilitation device with man-machine kinematic compatibility. This upper limb exoskeleton rehabilitation device has seven degrees of freedom and thus can improve patient comfort in use.

In these three upper limb exoskeleton rehabilitation devices, since the number of degrees of freedom of the respective device is less than the number of degrees of freedom of the upper limb of the human body, dislocation may occur between the upper limb joints of the patient and corresponding joints of the device during the motion. Although the device disclosed in Chinese Patent Application Publication No. 103070756 can allow deviation between the joint axis of the patient and the joint axis of the device, which improves the comfort degree of the patient wearing the device, it still cannot control the attitude of the patient's upper limb, and thus the human-machine motion matching cannot be achieved, which undoubtedly has a negative impact on the rehabilitation effect of the patient's upper limb. In addition, the side-to-side interchanging is not considered in the above three upper limb exoskeleton rehabilitation devices, and thus, a left-side rehabilitation device and a right-side rehabilitation device must be provided in the hospital application, which directly leads to high cost.

SUMMARY OF THE INVENTION

In view of the above-described problems, the present invention provides an upper limb exoskeleton rehabilitation device with man-machine motion matching and side-to-side interchanging. By designing multiple rotation degrees of freedom, the side-to-side interchanging of the mechanical arm is achieved, the upper limb motion of the patient is well matched, and thus the device can be used for patients with left-side or right-side hemiplegia.

In order to achieve the above objective, according to an aspect of the present invention, there is provided an upper limb exoskeleton rehabilitation device with man-machine motion matching and side-to-side interchanging for man-machine motion matching and side-to-side interchanging of a mechanical arm, characterized by comprising: a chassis bracket assembly, a shoulder girdle abduction assembly, a side-to-side interchanging assembly and a mechanical arm coupling member;

the chassis bracket assembly includes a frame and a lifting unit mounted on the frame;

the shoulder girdle abduction assembly includes a shoulder girdle rotation joint and a shoulder girdle translation joint; the shoulder girdle rotation joint includes an upper rotation joint, a shoulder girdle rotation shaft, a lower rotation joint and steel tubes; the upper rotation joint and the lower rotation joint are coupled by the shoulder girdle rotation shaft and are rotatable around the shoulder girdle rotation shaft; the upper rotation joint is mounted on the lifting unit to be driven by the lifting unit to move up and down;

the side-to-side interchanging assembly includes an upper rotation joint, an upper locking assembly, a lower rotation joint and a lower locking assembly; the upper rotation joint includes an upper rotation joint supporting member and an upper rotation joint rotation shaft; the upper locking assembly is configured to lock and release the upper rotation joint rotation shaft; the lower rotation joint includes a lower rotation joint supporting member and a lower rotation joint rotation shaft; the lower locking assembly is configured to lock and release the lower rotation joint rotation shaft;

the upper rotation joint supporting member is mounted on the steel tubes, the upper rotation joint rotation shaft is rotatably mounted on the upper rotation joint supporting member, and the lower rotation joint supporting member is fixedly mounted on the upper rotation joint rotation shaft; the lower rotation joint rotation shaft is rotatably mounted on the lower rotation joint supporting member, the mechanical arm coupling member is fixedly coupled to the lower rotation joint rotation shaft, and the mechanical arm coupling member is configured to mount the mechanical arm and drive the mechanical arm to rotate with the respective rotating joints, thereby achieving the man-machine motion matching and side-to-side interchanging of the mechanical arm.

Another object of the present invention is to exert a counterweight force on the corresponding joint of the mechanical arm without affecting other joints through the guiding of the rope and the transmission of the counterweight force, thereby greatly reducing the driving force required for the joint motion of the mechanical arm and thus making the arm mechanical small and light.

In order to achieve the above objective, the upper limb exoskeleton rehabilitation device with man-machine motion matching and side-to-side interchanging further comprises a shoulder abduction counterweight mechanism assembly; the shoulder abduction counterweight mechanism assembly includes a shoulder abduction counterweight block and a shoulder abduction counterweight rope as well as a vertical guide rail, a horizontal guide rail supporting member, a horizontal guide rail, a counterweight turntable wire rope connecting member, a counterweight turntable wire rope and a shoulder abduction counterweight turntable disposed on the mechanical arm coupling member;

the horizontal guide rail is fixed to the sliding block of the vertical guide rail by the horizontal guide rail supporting member; the counterweight turntable wire rope has one end fixed to a sliding block of the horizontal guide rail by the counterweight turntable wire rope connecting member and the other end fixed to the shoulder abduction counterweight turntable; the shoulder abduction counterweight turntable is configured to fixedly connect the mechanical arm and is rotatable around the mechanical arm coupling member with the mechanical arm; the shoulder abduction counterweight rope has one end hung with the shoulder abduction counterweight block for the counterweight, and the other end fixed to the horizontal guide rail supporting member.

Further, the shoulder girdle rotation shaft, the upper rotation joint rotation shaft and the lower rotation joint rotation shaft are hollow rotation shafts; the shoulder abduction counterweight rope passes through the shoulder girdle rotation shaft, the upper rotation joint rotation shaft and the lower rotation joint rotation shaft in sequence, and then is fixed to the horizontal guide rail supporting member; the shoulder abduction counterweight rope is guided by guide pulleys in the travelling path.

Further, the shoulder abduction counterweight mechanism assembly further includes a shoulder abduction counterweight guide groove; the end of the shoulder abduction counterweight rope hung with the shoulder abduction counterweight block is guided by fixed pulleys and then enters the frame, with a shoulder abduction counterweight guide groove hung terminally;

the chassis bracket assembly is provided with a guide rod matched with the shoulder abduction counterweight guide groove for limiting the lifting path of the shoulder abduction counterweight guide groove.

Further, the lifting unit includes an active lifting mechanism and a passive lifting mechanism; the passive lifting mechanism includes a passive lifting support plate, a passive lifting polish rod and a passive lifting platform; the passive lifting support plate is mounted on the active lifting mechanism to move up and down with the active lifting mechanism, the passive lifting polish rod is fixed to the passive lifting support plate, and the passive lifting platform is movable up and down along the passive lifting polish rod; a mechanical arm overall counterweight block and a mechanical arm overall counterweight wire rope are further provided on the frame; the mechanical arm overall counterweight wire rope has one end fixed to the passive lifting platform and the other end hung with the mechanical arm overall counterweight block for the counterweight after being guided by fixed pulleys, thereby achieving passive up-and-down movement.

Further, the upper locking assembly includes an upper pin shaft, an upper handle and an upper spring; the upper handle and the upper pin shaft are fixedly coupled; the upper spring is sleeved on the upper pin shaft and has an upper end abutted against the upper rotation joint supporting member and a lower end abutted against the upper handle; the upper pin shaft is capable of being inserted into or pulled out of corresponding holes of the lower rotation joint supporting member and the upper rotation joint supporting member.

Further, the lower locking assembly includes a lower locking supporting member, a lower handle, a lower pin shaft and a lower spring; the lower handle and the lower pin shaft are fixedly coupled, and the lower locking supporting member is fixed to the mechanical arm coupling member; the lower spring is sleeved on the lower pin shaft and has an upper end abutted against the lower handle and a lower end abutted against the lower locking supporting member; the lower pin shaft is capable of being inserted into or pulled out of a corresponding hole of the lower rotation joint supporting member.

In general, by comparing the above technical solution of the present invention with the prior art, the present invention has the following beneficial effects:

1. provided is an upper limb exoskeleton rehabilitation device with man-machine motion matching and side-to-side interchanging, in which through the freedom degree arrangement for the man-machine motion matching and side-to-side interchanging, not only can the device be applied to patients with hemiplegia on the different sides, but also the motion interference between the device and the patient's upper limb is eliminated, which is difficult for the general upper limb exoskeleton rehabilitation device;

2. there are four passive degrees of freedom in the device of the present invention, and in addition to being able to perform various complex active and passive training actions, the device can also adapt to the sizes of the affected limbs of different patients and be adaptive to the attitude of the upper limb of the patient in the training process;

3. the device of the present invention comprises three different types of counterweight mechanisms, and the counterweight mechanisms enable change in the direction of the counterweight force with the side-to-side interchanging of the device, which always plays a role in reducing the driving torque of the corresponding joint the mechanical arm; and 4. the upper limb exoskeleton rehabilitation device with man-machine motion matching and side-to-side interchanging of the present invention has high practical value, and has great advantages in improving the safety of rehabilitation training, reducing hospital procurement cost, reducing volume and weight, reducing device production cost, enhancing compliance and other aspects.

DETAILED DESCRIPTION OF THE EMBODIMENTS

For clear understanding of the objectives, features and advantages of the present invention, detailed description of the present invention will be given below in conjunction with accompanying drawings and specific embodiments. It should be noted that the embodiments described herein are only meant to explain the present invention, and not to limit the scope of the present invention. Furthermore, the technical features related to the embodiments of the invention described below can be mutually combined if they are not found to be mutually exclusive.

Figure 1:
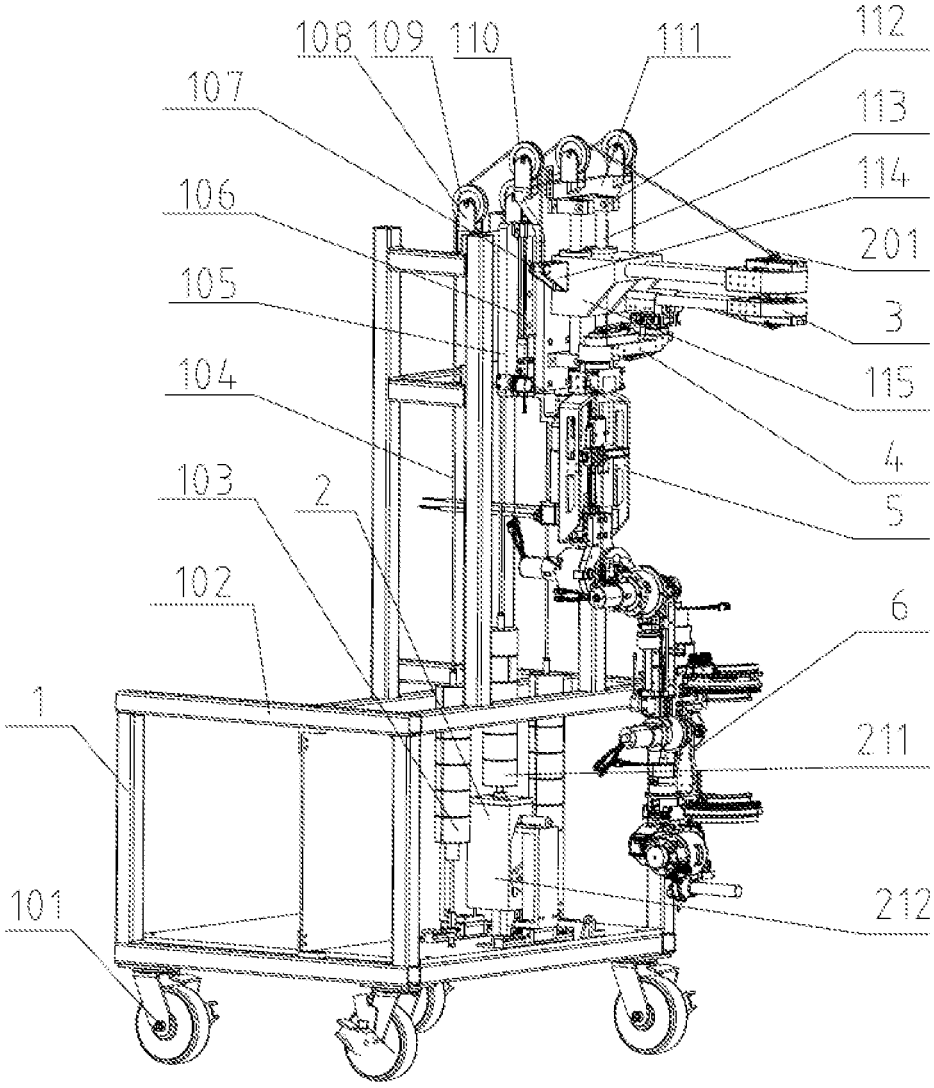
FIG. 1 is a schematic structural diagram of an upper limb exoskeleton rehabilitation device according to a preferred embodiment of the present invention.
Figure 2:
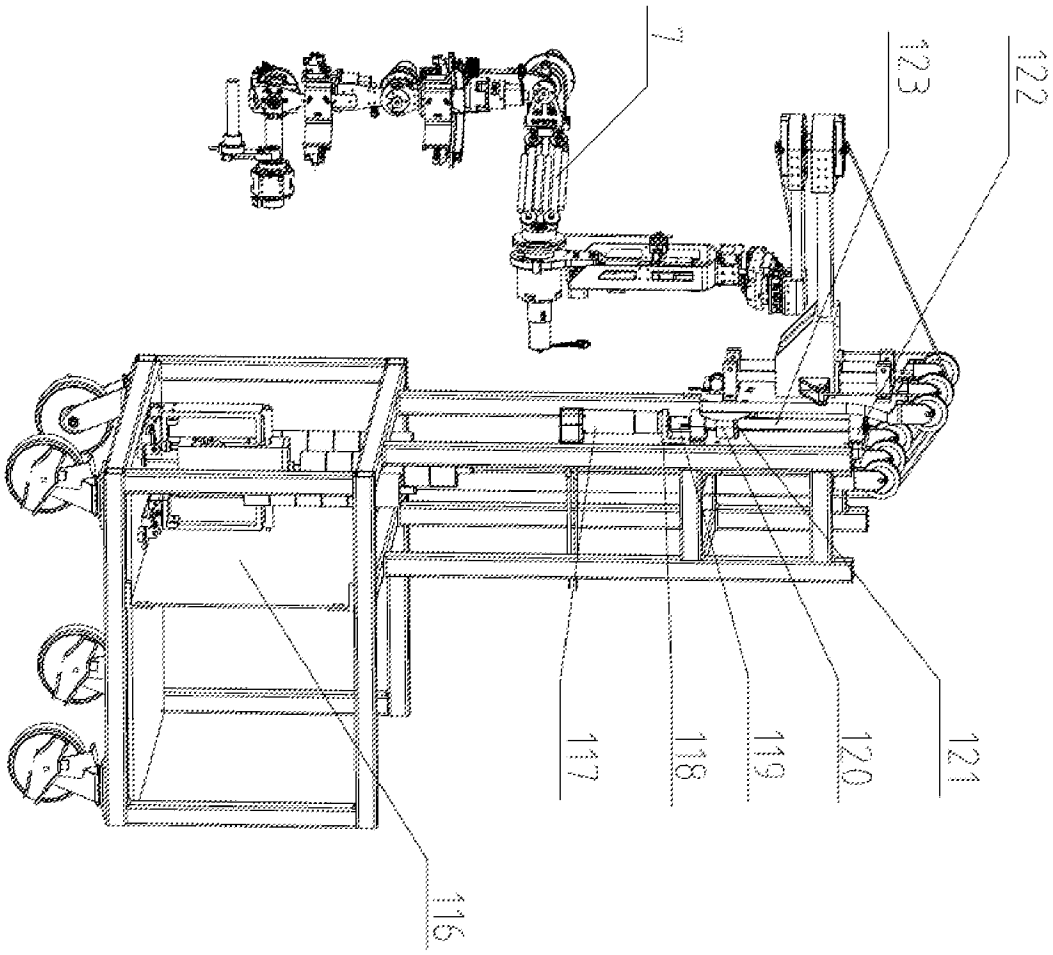
FIG. 2 is a schematic structural diagram of the upper limb exoskeleton rehabilitation device in FIG. 1 in another perspective.

As shown in FIGS. 1-2, an upper limb exoskeleton rehabilitation device with man-machine motion matching and side-to-side interchanging includes a chassis bracket assembly 1, a shoulder abduction counterweight mechanism assembly 2, a shoulder girdle abduction assembly 3, a side-to-side interchanging assembly 4, a mechanical arm coupling assembly 5 and a nine-degree-of-freedom mechanical arm 6.

The shoulder abduction counterweight mechanism assembly 2 has one end mounted on the chassis bracket assembly 1 and the other end mounted on the mechanical arm coupling assembly 5, the shoulder girdle abduction assembly 3 has a part mounted on the chassis bracket assembly 1 and the other part mounted on the mechanical arm coupling assembly 5, the side-to-side interchanging assembly 4 is mounted on the part of the shoulder girdle abduction assembly 3, the mechanical arm coupling assembly 5 is mounted on the side-to-side interchanging assembly 4, and the nine-degree-of-freedom mechanical arm 6 is mounted on the other part of the shoulder girdle abduction assembly 3.

Specific description will be given below for the structure and function of each assembly.

The chassis bracket assembly 1 includes a machine bracket mechanism, an active lifting mechanism, a passive lifting mechanism and a mechanical arm overall counterweight mechanism. The machine bracket mechanism includes casters 101, a welded frame 102 and an electrical support plate 116. The active lifting mechanism includes an active lifting support plate 105, an active lifting guide rail 106, an active lifting motor 117, an active lifting motor supporting member 118, an active lifting motor coupling 119, an active and passive lifting connecting member 120, an active lifting screw nut 121, an active lifting screw fixing member 122 and an active lifting screw 123. The passive lifting mechanism includes a passive lifting support plate 111, a passive lifting polish rod fixing member 112, a passive lifting polish rod 113, a passive lifting platform 115 and a passive lifting platform lug 114. The mechanical arm overall counterweight mechanism includes a mechanical arm overall counterweight block 103, a mechanical arm overall counterweight wire rope 104, a primary-secondary nail 107, a mechanical arm overall counterweight pulley supporting member 108, a first mechanical arm overall counterweight pulley 109 and a second mechanical arm overall counterweight pulley 110.

The machine bracket mechanism is used to support the entire device, the casters 101 are mounted on the underside of the welded frame 102, and the electrical support plate 116 is mounted inside the welded frame 102. The active lifting support plate 105 is fixedly mounted on the welded frame 102 on which the active lifting guide rail 106, the active lifting motor supporting member 118, the active lifting screw nut 121, the active lifting screw fixing member 122 and the active lifting screw 123 are fixed. The active lifting motor 117 is mounted on the active lifting motor supporting member 118. The active lifting screw 123 is connected to the active lifting motor 117 by the active lifting motor coupling 119. The active and passive lifting connecting member 120 is mounted on the active lifting screw nut 121. The passive lifting support plate 111 is connected to the active lifting support plate 105 by the active lifting guide rail 106 and the active and passive lifting connecting member 120. Therefore, the active lifting motor 117 can control the up-and-down movement of the passive lifting support plate 111 by the active lifting screw 123.

The passive lifting polish rod fixing member 112 and the passive lifting polish rod 113 are mounted on the passive lifting support plate 111. The passive lifting platform 115 is mounted on the passive lifting polish rod 113, and the passive lifting platform lug 114 is fixedly mounted on the passive lifting platform 115, so that the passive lifting platform 115 can freely move up and down on the passive lifting polish rod 113.

The mechanical arm overall counterweight block 103 has one end connected to the primary-secondary nail 107 (which is fixed to the passive lifting platform lug 114) by the mechanical arm overall counterweight wire rope 104, and the other end mounted on in the welded frame 102 in a vertically movable manner. The mechanical arm overall counterweight wire rope 104 is guided by the first mechanical arm overall counterweight pulley 109 and the second mechanical arm overall counterweight pulley 110 to ensure that both ends are vertically downward, so that the weight of the mechanical arm mounted on the passive lifting platform 115 is balanced by the gravity of the mechanical arm overall counterweight block 103.

Figure 3:
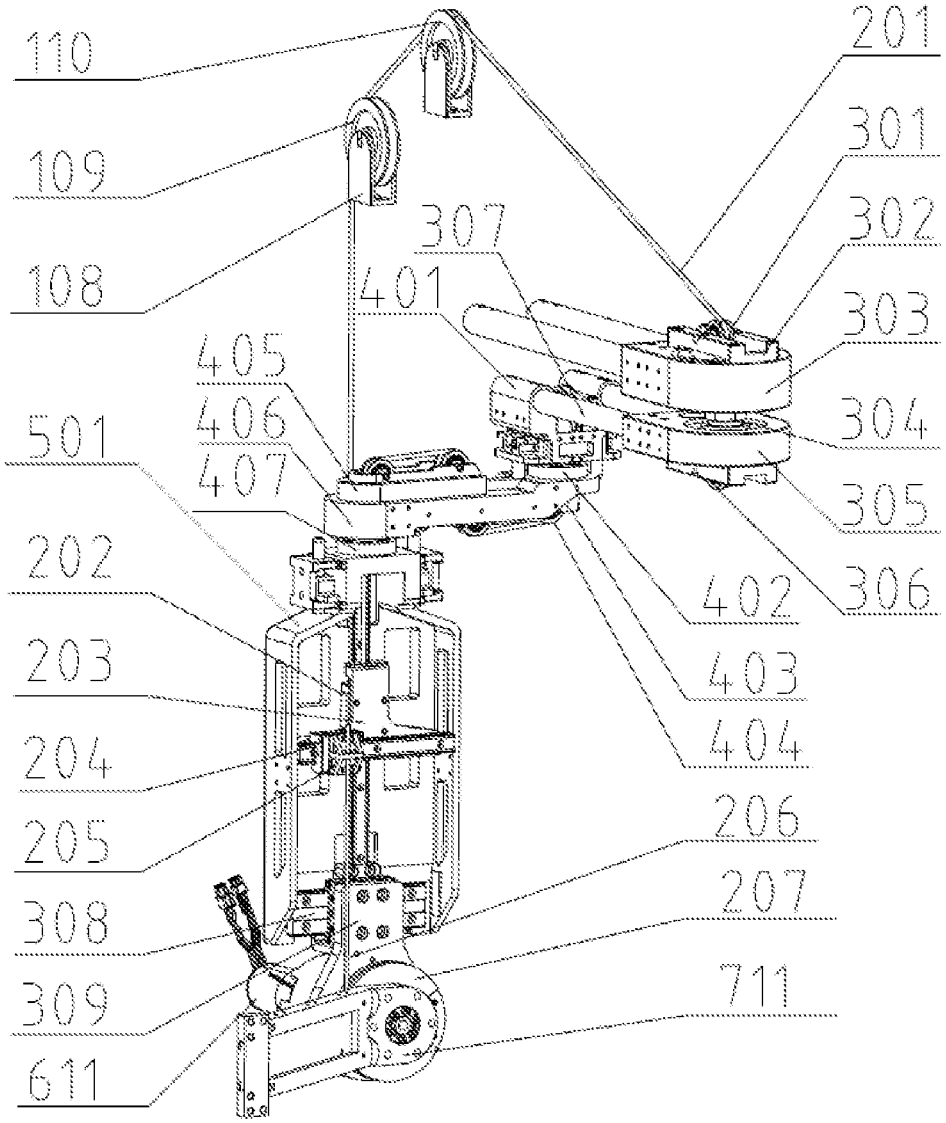
FIG. 3 is a schematic structural diagram showing a shoulder abduction counterweight mechanism assembly, a shoulder girdle abduction assembly and a mechanical arm coupling assembly according to the present invention.

As shown in FIG. 3, the mechanical arm coupling assembly includes a mechanical arm coupling member 501. The shoulder girdle abduction assembly includes a shoulder girdle rotation joint and a shoulder girdle translation joint. The shoulder girdle rotation joint includes an upper rotation joint 303, a shoulder girdle rotation shaft 304, a lower rotation joint 305, a first shoulder girdle counterweight guide pulley 301, a second shoulder girdle counterweight guide pulley 306, shoulder girdle counterweight guide pulley supports 302 and steel tubes 307. The upper rotation joint 303 and the lower rotation joint 305 are coupled by the shoulder girdle rotation shaft 304, and are rotatable around the shoulder girdle rotation shaft 304. The first shoulder girdle counterweight guide pulley 301 and the second shoulder girdle counterweight guide pulley 306 are respectively mounted on the two shoulder girdle counterweight guide pulley supports 302, and the two shoulder girdle counterweight guide pulley supports 302 are then respectively mounted on the upper rotation joint 303 and the lower rotation joint 305. The shoulder girdle rotation shaft 304 is a hollow shaft, and a shoulder abduction counterweight rope 201 can be guided by the first shoulder girdle counterweight guide pulley 301 and the second shoulder girdle counterweight guide pulley 306 to pass through the shoulder girdle rotation shaft 304, so that the shoulder abduction counterweight rope 201 passes by the shoulder girdle rotation joints without affecting the shoulder girdle rotation joints. The shoulder girdle translation joint includes a shoulder girdle guide rail 308 and a shoulder girdle guide rail connecting member 309. The shoulder girdle guide rail 308 is mounted on the mechanical arm coupling member 501. The shoulder girdle guide rail connecting member 309 is mounted on the sliding block of the shoulder girdle guide rail 308, and can freely move along the shoulder girdle guide rail 308. The shoulder girdle rotation joint and the shoulder girdle translation joint can be adaptive to the motion of the patient's shoulder girdle, thereby making the nine-degree-of-freedom mechanical arm connected in series with the shoulder girdle abduction assembly more conformable to the upper-limb motion of the patient.

As shown in FIGS. 1 and 3, the shoulder abduction counterweight mechanism assembly includes a shoulder abduction counterweight guide groove 212, a shoulder abduction counterweight block 211, a shoulder abduction force transmission mechanism and a shoulder abduction counterweight turntable 207. The shoulder abduction force transmission mechanism includes a shoulder abduction counterweight rope 201, a vertical guide rail 202, a horizontal guide rail supporting member 203, a horizontal guide rail 204, a counterweight turntable wire rope connecting member 205 and a counterweight turntable wire rope 206. As can be seen from the figures, the shoulder abduction counterweight guide groove 212 has a lower end that is mounted on the welded frame 102 and movable in the vertical direction, and an upper end mounted on the shoulder abduction counterweight block 211. The shoulder abduction counterweight rope 201 has one end fixed to the shoulder abduction counterweight block 211 and the other end guided by the plurality of guide pulleys to pass through a plurality of mechanical arm rotation centers and finally fixed to the horizontal guide rail supporting member 203. The horizontal guide rail supporting member 203 is mounted on the vertical guide rail 202 and can freely move up and down. The vertical guide rail 202 is fixedly mounted on the mechanical arm coupling member 501. The counterweight turntable wire rope connecting member 205 is mounted on the horizontal guide rail 204, and the counterweight turntable wire rope 206 has an upper end fixed to the counterweight turntable wire rope connecting member 205 and a lower end wound in the groove of the shoulder abduction counterweight turntable 207 by a half circle and fixed to the shoulder abduction counterweight turntable 207.

Thus, the gravity of the shoulder abduction counterweight block 211 can be transferred to the horizontal guide rail supporting member 203 by the shoulder abduction counterweight rope 201, and then the counterweight turntable wire rope connecting member 205 transfers the force in the vertical direction to the shoulder abduction counterweight turntable 207 by the counterweight turntable wire rope 206. In the process of transferring the counterweight force, the counterweight rope is divided into the shoulder abduction counterweight rope 201 and the counterweight turntable wire rope 206, and the upper end of the counterweight turntable wire rope 206 is fixed to the counterweight turntable wire rope connecting member 205 which can freely move horizontally, so that the counterweight turntable wire rope 206 can move synchronously with the shoulder girdle translation joint so as to always provide a corresponding counterweight torque. No matter how large the counterweight force provided by the shoulder abduction counterweight mechanism assembly is, the motions of the shoulder girdle rotation joint and the shoulder girdle translation joint are not affected, thereby achieving transmission of the force and motion across the rotation joint and the translation joint.

Figure 4:
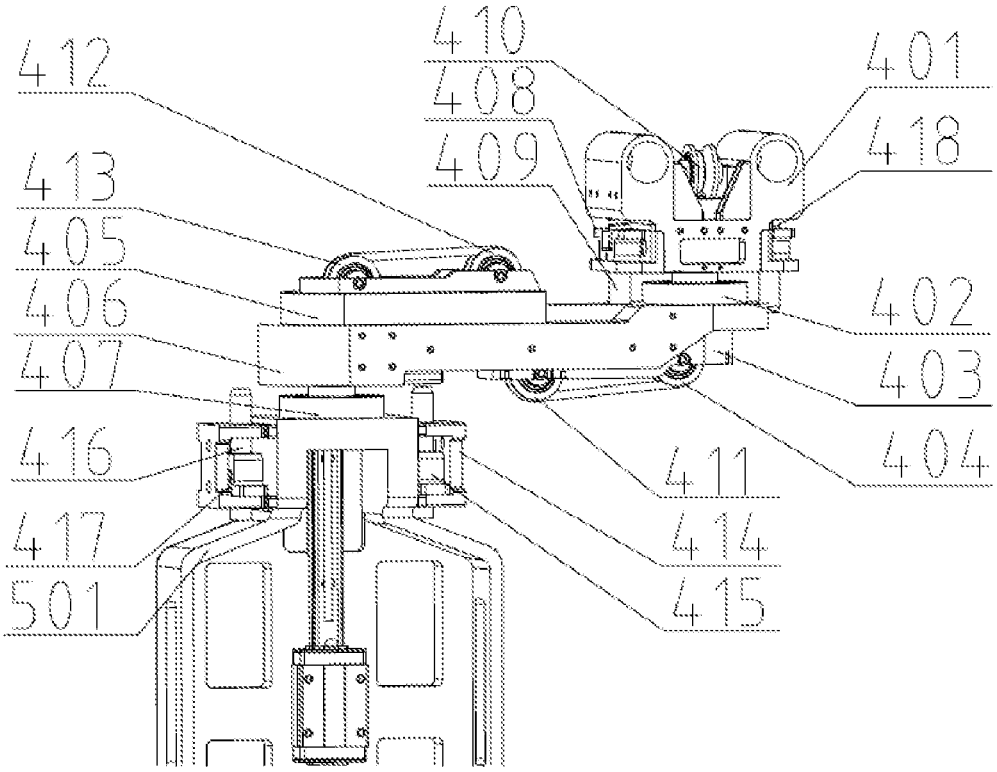
FIG. 4 is a schematic structural diagram of a side-to-side interchanging assembly according to the present invention.

As shown in FIG. 4, the side-to-side interchanging assembly includes an upper rotation joint, an upper locking assembly, a lower rotation joint and a lower locking assembly. The upper rotation joint includes an upper rotation joint supporting member 401, an upper rotation joint rotation shaft 402, a first upper rotation joint counterweight guide pulley 410, a second upper rotation joint counterweight guide pulley 404, a third upper rotation joint counterweight guide pulley 411 and an upper rotation joint guide pulley bracket 403. The upper locking assembly includes an upper pin shaft 409, an upper handle 408 and an upper spring 418. The lower rotation joint includes a lower rotation joint supporting member 406, a lower rotation joint rotation shaft 407, a first lower rotation joint counterweight guide pulley 412, a second lower rotation joint counterweight guide pulley 413 and a lower rotation joint counterweight guide pulley bracket 405. The lower locking assembly includes a lower locking supporting member 414, a lower handle 415, a lower pin shaft 416 and a lower spring 417.

As shown in FIGS. 3 and 4, the upper rotation joint supporting member 401 is fixed to the steel tubes 307 to connect the shoulder girdle rotation joint and the side-to-side interchanging assembly in series. The lower rotation joint supporting member 406 is fixedly mounted on the upper rotation joint rotation shaft 402, and the upper rotation joint rotation shaft 402 is rotatably mounted on the upper rotation joint supporting member 401, so that the lower rotation joint can be rotated relative to the upper rotation joint. The upper handle 408 and the upper pin shaft 409 are directly and fixedly coupled. The upper spring 418 is sleeved on the upper pin shaft 409, and has an upper end abutted against the upper rotation joint supporting member 401 and a lower end abutted against the upper handle 408. The upper pin shaft 409 can be inserted into corresponding holes in the lower rotation joint supporting member 406 and the upper rotation joint supporting member 401, and the height of the inner holes is greater than the length of the upper pin shaft 409, the upper pin shaft 409 can be moved up and down. Since the upper spring 418 is always in a compressed state, the upper handle 408 is pushed downward to allow the upper pin shaft 409 to be inserted into the hole of the lower rotation joint supporting member 406, so that the lower rotation joint cannot be rotated relative to the upper rotation joint. When the lower rotation joint needs to be rotated, it is necessary to lift the upper handle 408 to pull the upper pin shaft 409 out of the hole of the lower rotation joint supporting member 406. The lower rotation joint rotation shaft 407 is rotatably mounted on the lower rotation joint supporting member 406, and the mechanical arm coupling member 501 is fixedly coupled to the lower rotation joint rotation shaft 407, so that the mechanical arm coupling member 501 can be freely rotated relative to the lower rotation joint supporting member 406. The lower handle 415 is fixedly coupled to the lower pin shaft 416, and the lower locking supporting member 414 is fixed to the mechanical arm coupling member 501. The lower spring 417 is sleeved on the lower pin shaft 416, and has an upper end abutted against the lower handle 415 and a lower end abutted against the lower locking supporting member 414. Since the lower spring 417 is always in a compressed state, the lower handle 415 is pushed upward to allow the lower pin shaft 416 to be inserted into a corresponding hole of the lower rotation joint supporting member 406, so that the mechanical arm coupling member 501 cannot be rotated relative to the lower rotation joint supporting member 406. After the lower handle 415 is pushed down and the lower pin shaft 416 is pulled out of the hole of the lower rotation joint supporting member 406, the mechanical arm coupling member 501 can be rotated relative to the lower rotation joint supporting member 406 again. When the side-to-side interchanging needs to be performed, the upper rotation joint and the lower rotation joint are respectively rotated by 180 degrees.

Figure 5:
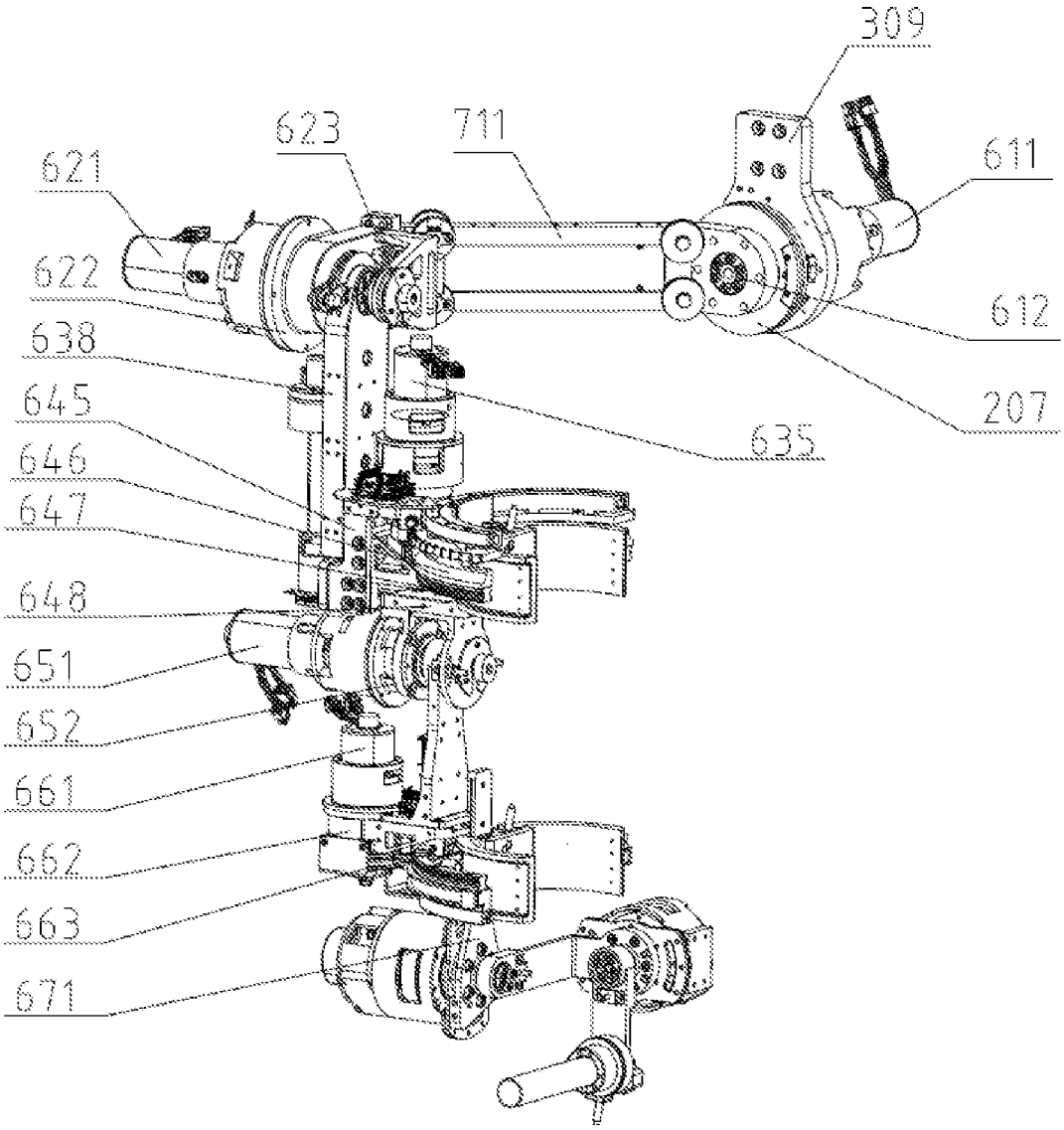
FIG. 5 is a schematic structural diagram of a nine-degree-of-freedom mechanical arm used in the used in a specific application of the present invention.
Figure 6:
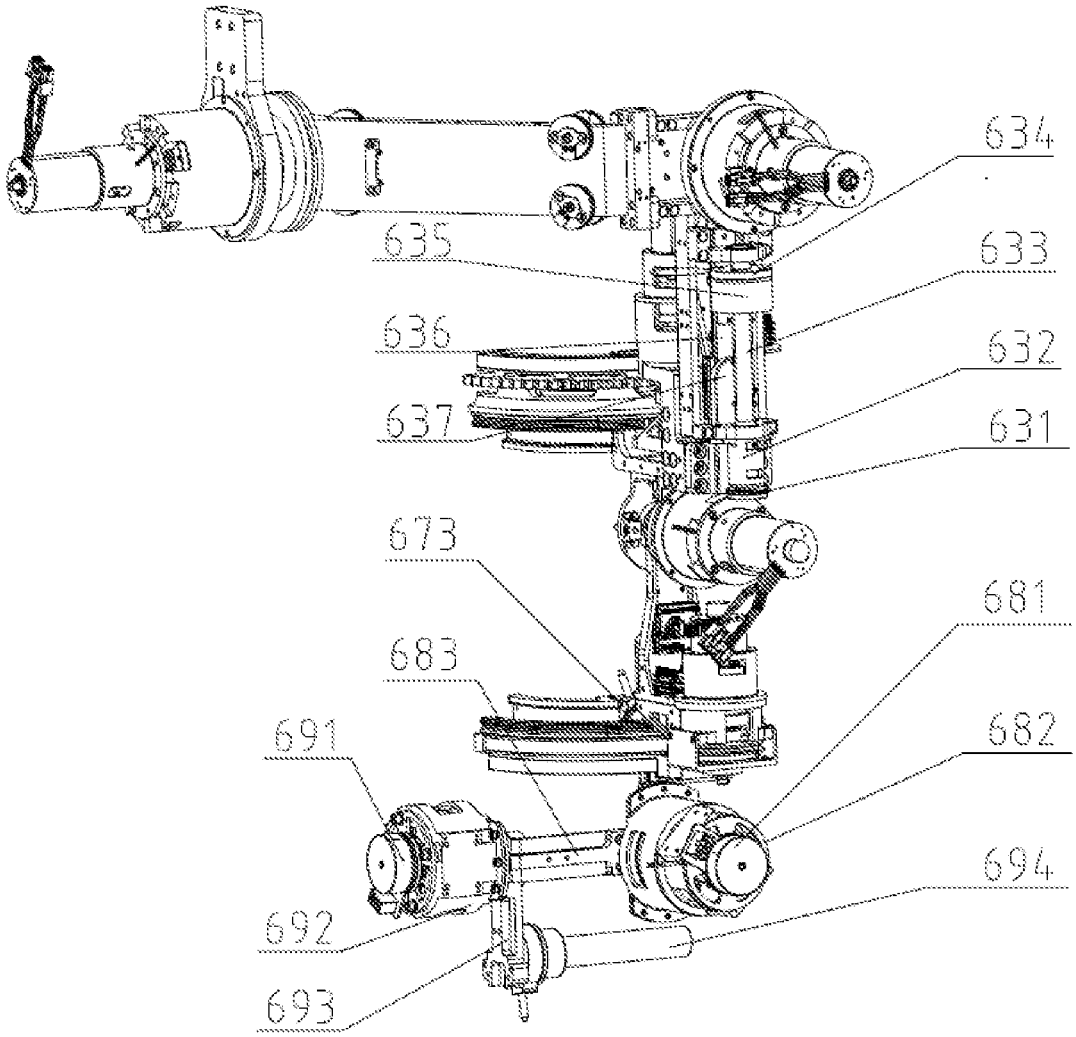
FIG. 6 is a schematic structural diagram of the nine-degree-of-freedom mechanical arm in FIG. 5 in another perspective.

As shown in FIGS. 5 and 6, the nine-degree-of-freedom mechanical arm includes a shoulder abduction/adduction joint, a shoulder flexion/extension joint, a shoulder internal rotation/external rotation joint, an elbow flexion/extension joint, an elbow pronation/supination joint, a wrist flexion/extension joint, a wrist ulna deviation/radial deviation joint, an upper arm length adjustment joint and a lower arm length adjustment joint. The shoulder abduction/adduction joint includes a shoulder abduction motor 611 and a shoulder abduction rotating shaft 612. The shoulder flexion/extension joint includes a shoulder flexion motor 621, a shoulder flexion supporting member 622 and a shoulder flexion rotating shaft 623. The shoulder internal rotation/external rotation joint includes a shoulder internal rotation motor 641, a shoulder internal rotation rotating shaft 642, a shoulder internal rotation gear ring 643, an upper arm restraint chamber 644, a shoulder internal rotation supporting member 645, a shoulder internal rotation gear ring connecting member 646, a shoulder internal rotation curved guide rail 647 and an upper arm restraint chamber supporting member 648. The elbow flexion/extension joint includes an elbow flexion and extension motor 651, an elbow flexion and extension supporting member 652, an elbow flexion and extension rotating shaft 653 and a lower arm bracket 654. The elbow pronation/supination joint includes an elbow pronation motor 661, an elbow pronation supporting member 662, an elbow pronation turntable 663, an elbow pronation curved guide rail 664 and an elbow pronation curved guide rail connecting member 665. The wrist flexion/extension joint includes a wrist flexion and extension motor 681, a wrist flexion and extension supporting member 682 and a wrist flexion and extension rotating shaft 683. The wrist ulna deviation/radial deviation joint includes a wrist ulna deviation motor 691, a wrist ulna deviation supporting member 692, a handle supporting member 693 and a handle 694. The upper arm length adjustment joint includes an upper arm length adjustment motor 631, an upper arm length adjustment motor supporting member 632, an upper arm screw 633, an upper arm screw nut 634, an upper arm screw nut connecting member 635, an upper arm guide rail 636, an upper arm guide rail connecting member 637 and an upper arm bracket 638. The lower arm length adjustment joint includes a lower arm guide rail connecting member 671, a lower arm restraint chamber 672 and a lower arm guide rail 673.

The shoulder abduction motor 611 is mounted on the shoulder girdle guide rail connecting member 309. The shoulder abduction rotating shaft 612 is driven by the shoulder abduction motor 611 to rotate the shoulder abduction/adduction joint. A shoulder extension connecting member 711 is fixed to the shoulder abduction rotating shaft 612, and is further connected to the shoulder flexion supporting member 622. The shoulder flexion rotating shaft 623 is mounted on the shoulder flexion supporting member 622, and is driven by the shoulder flexion motor 621 to rotate the shoulder flexion/extension joint. The upper arm guide rail 636 and the upper arm length adjustment motor supporting member 632 are mounted on the upper arm bracket 638, while the upper arm guide rail connecting member 637 and the upper arm screw nut connecting member 635 are both mounted on the upper arm guide rail 636, and the upper arm screw nut 634 is mounted on the upper arm screw nut connecting member 635. The upper arm length adjustment motor 631 enables, by driving the upper arm screw 633 to rotate, the upper arm screw nut 634 to move up and down so as to adjust the upper arm length. The upper arm guide rail connecting member 637 is coupled to the shoulder internal rotation supporting member 645. The shoulder internal rotation motor 641 is mounted on the shoulder internal rotation supporting member 645 to drive the shoulder internal rotation rotating shaft 642 to rotate. The shaft end of the shoulder internal rotation rotating shaft 642 has a dentiform portion which can be engaged with the shoulder internal rotation gear ring 643. The shoulder internal rotation gear ring 643 is mounted on the shoulder internal rotation gear ring connecting member 646, and then are mounted together on the shoulder internal rotation curved guide rail 647. Therefore, the shoulder internal rotation motor 641 can drive the shoulder internal rotation/external rotation joint to rotate. The upper arm restraint chamber 644 is mounted on the upper arm restraint chamber supporting member 648, and the upper arm restraint chamber supporting member 648 has an upper end connected to the shoulder internal rotation gear ring connecting member 646 and a lower end connected to the elbow flexion and extension supporting member 652. The elbow flexion and extension motor 651 is mounted on the elbow flexion and extension supporting member 652 to drive the elbow flexion and extension rotating shaft 653 to rotate the elbow flexion/extension joint. The lower arm bracket 654 is configured to couple the elbow flexion and extension rotating shaft 653 and the elbow pronation supporting member 662. The elbow pronation motor 661 is mounted on the elbow pronation supporting member 662 to drives the elbow pronation turntable 663 to rotate, and the elbow pronation turntable 663 is connected to the elbow pronation curved guide rail connecting member 665 by a rope. Since the elbow pronation curved guide rail connecting member 665 is provided with the elbow pronation curved guide rail 664, the elbow pronation curved guide rail connecting member 665 can be driven by the elbow pronation turntable 663 to rotate, so that the elbow flexion/extension joint is rotated. The lower arm guide rail 673 couples the lower arm guide rail connecting member 671 and the elbow pronation curved guide rail connecting member 665. Therefore, the lower arm guide rail connecting member 671 can be moved along the lower arm guide rail 673 so that the lower arm length can be adjusted. The lower arm restraint chamber 672 is fixed to the lower arm guide rail connecting member 671 and used for fixing the lower arm of the patient. The wrist flexion and extension supporting member 682 is mounted on the lower arm guide rail connecting member 671, and the wrist flexion and extension motor 681 is mounted on the wrist flexion and extension supporting member 682 to drive the wrist flexion and extension rotating shaft 683 to rotate, so that the wrist flexion/extension joint is rotated. The wrist ulna deviation supporting member 692 is mounted on the wrist flexion and extension rotating shaft 683, and the wrist ulna deviation motor 691 is mounted on the wrist ulna deviation supporting member 692 to drive the handle supporting member 693 to rotate, so that the wrist ulna deviation/radial deviation joint is rotated. The handle 694 is mounted on the handle supporting member 693 and used for being gripped by the patient to control the motion of the whole device.

Figure 7:
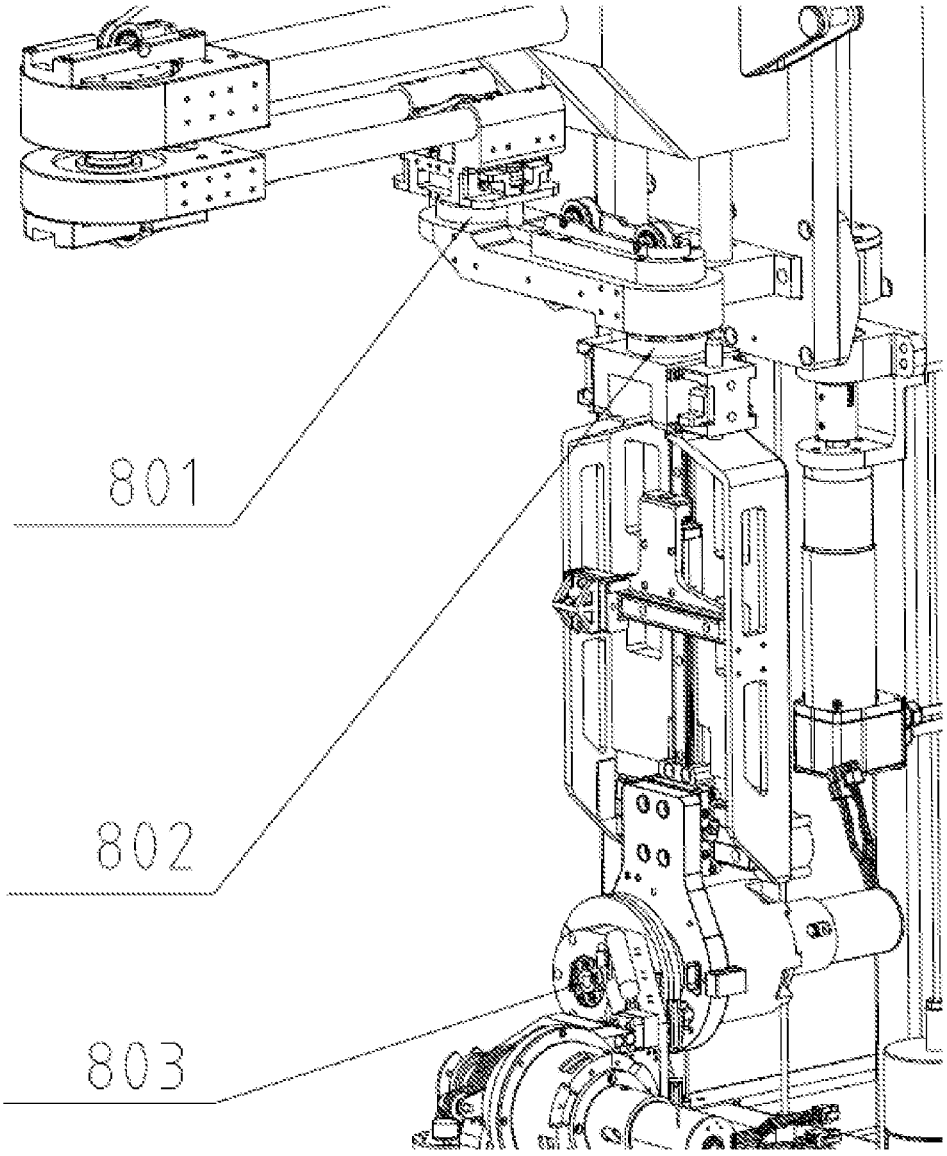
FIG. 7 is a schematic structural diagram of the upper limb exoskeleton rehabilitation device in FIG. 1 after side-to-side interchanging.
Figure 8:
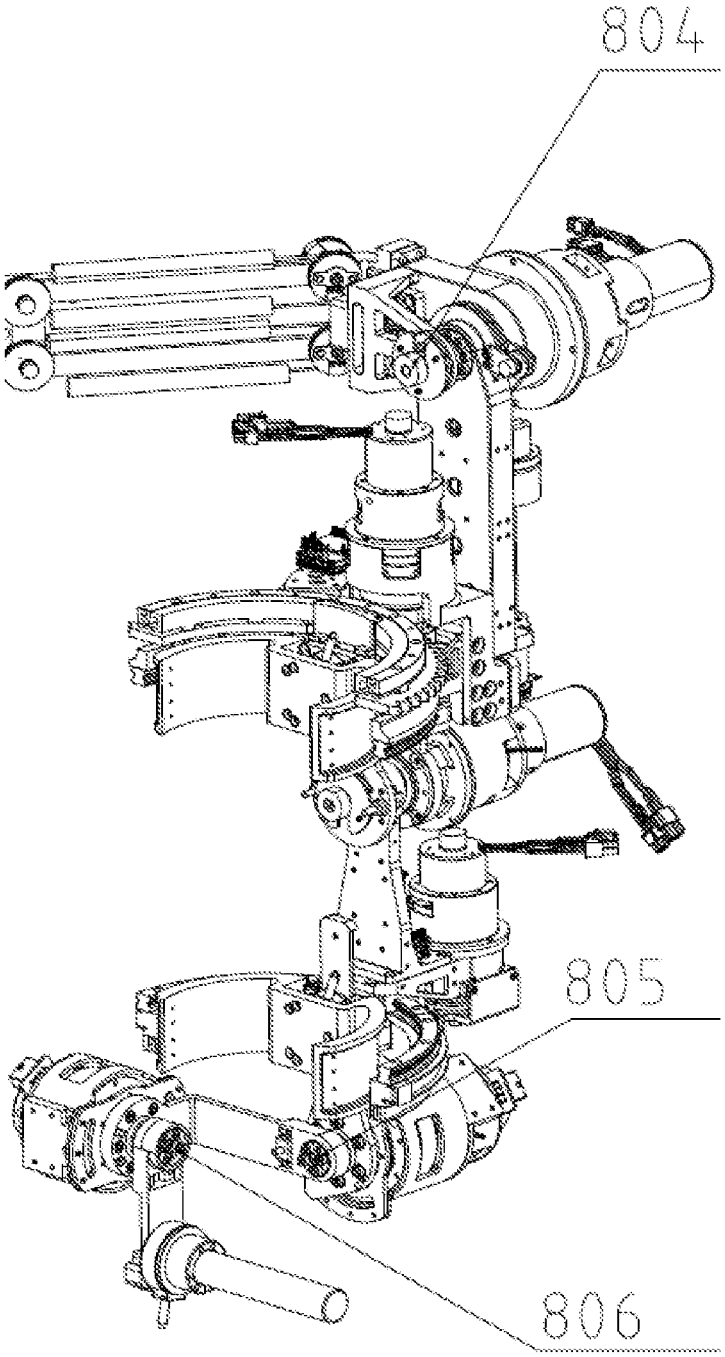
FIG. 8 is a schematic structural diagram of the upper limb exoskeleton rehabilitation device in FIG. 7 in another perspective.

As shown in FIGS. 7 and 8, when the device needs to be switched from the right side mode to the left side mode, it is necessary to rotate an upper rotation joint 801, a lower rotation joint 802, the shoulder abduction/adduction joint 803, the shoulder flexion/extension joint 804, the wrist flexion/extension joint 805 and the wrist ulna deviation/radial deviation joint 806. Through rotating the above joints by 180 degrees, the state shown in FIG. 1 can be converted into the state shown in FIG. 7, that is, the side-to-side interchanging is completed.

It should be readily understood to those skilled in the art that the above description is only preferred embodiments of the present invention, and does not limit the scope of the present invention. Any change, equivalent substitution and modification made without departing from the spirit and scope of the present invention should be included within the scope of the protection of the present invention.

What is claimed is:

1. An upper limb exoskeleton rehabilitation device with man-machine motion matching and side-to-side interchanging for man-machine motion matching and side-to-side interchanging of a mechanical arm, characterized by comprising: a chassis bracket assembly, a shoulder girdle abduction assembly, a side-to-side interchanging assembly and a mechanical arm coupling member;

the chassis bracket assembly includes a frame and a lifting unit mounted on the frame;

the shoulder girdle abduction assembly includes a shoulder girdle rotation joint and a shoulder girdle translation joint; the shoulder girdle rotation joint includes a shoulder girdle upper rotation joint, a shoulder girdle rotation shaft, a shoulder girdle lower rotation joint and steel tubes; the shoulder girdle upper rotation joint and the shoulder girdle lower rotation joint are coupled by the shoulder girdle rotation shaft and are rotatable around the shoulder girdle rotation shaft; the shoulder girdle upper rotation joint is mounted on the lifting unit to be driven by the lifting unit to move up and down;

the side-to-side interchanging assembly includes an interchanging assembly upper rotation joint, an upper locking assembly, an interchanging assembly lower rotation joint and a lower locking assembly; the interchanging assembly upper rotation joint includes an upper rotation joint supporting member and an upper rotation joint rotation shaft; the upper locking assembly is configured to lock and release the upper rotation joint rotation shaft; the lower rotation joint includes a lower rotation joint supporting member and a lower rotation joint rotation shaft; the lower locking assembly is configured to lock and release the lower rotation joint rotation shaft, the interchanging assembly lower rotation joint configured to be rotated relative to the interchanging assembly upper rotation joint;

the upper rotation joint supporting member is mounted on the steel tubes, the upper rotation joint rotation shaft is rotatably mounted on the upper rotation joint supporting member, and the lower rotation joint supporting member is fixedly mounted on the upper rotation joint rotation shaft; the lower rotation joint rotation shaft is rotatably mounted on the lower rotation joint supporting member, the mechanical arm coupling member is fixedly coupled to the lower rotation joint rotation shaft, and the mechanical arm coupling member is configured to mount the mechanical arm and drive the mechanical arm to rotate with the respective rotating joints, thereby achieving the man-machine motion matching and side-to-side interchanging of the mechanical arm.

2. An upper limb exoskeleton rehabilitation device with man-machine motion matching and side-to-side interchanging for man-machine motion matching and side-to-side interchanging of a mechanical arm, characterized by comprising: a chassis bracket assembly, a shoulder girdle abduction assembly, a side-to-side interchanging assembly and a mechanical arm coupling member;

the chassis bracket assembly includes a frame and a lifting unit mounted on the frame;

the shoulder girdle abduction assembly includes a shoulder girdle rotation joint and a shoulder girdle translation joint; the shoulder girdle rotation joint includes a shoulder girdle upper rotation joint, a shoulder girdle rotation shaft, a shoulder girdle lower rotation joint and steel tubes; the shoulder girdle upper rotation joint and the shoulder girdle lower rotation joint are coupled by the shoulder girdle rotation shaft and are rotatable around the shoulder girdle rotation shaft; the shoulder girdle upper rotation joint is mounted on the lifting unit to be driven by the lifting unit to move up and down;

the side-to-side interchanging assembly includes an interchanging assembly upper rotation joint, an upper locking assembly, an interchanging assembly lower rotation joint and a lower locking assembly; the interchanging assembly upper rotation joint includes an upper rotation joint supporting member and an upper rotation joint rotation shaft; the upper locking assembly is configured to lock and release the upper rotation joint rotation shaft; the lower rotation joint includes a lower rotation joint supporting member and a lower rotation joint rotation shaft; the lower locking assembly is configured to lock and release the lower rotation joint rotation shaft;

the upper rotation joint supporting member is mounted on the steel tubes, the upper rotation joint rotation shaft is rotatably mounted on the upper rotation joint supporting member, and the lower rotation joint supporting member is fixedly mounted on the upper rotation joint rotation shaft; the lower rotation joint rotation shaft is rotatably mounted on the lower rotation joint supporting member, the mechanical arm coupling member is fixedly coupled to the lower rotation joint rotation shaft, and the mechanical arm coupling member is configured to mount the mechanical arm and drive the mechanical arm to rotate with the respective rotating joints, thereby achieving the man-machine motion matching and side-to-side interchanging of the mechanical arm; and a shoulder abduction counterweight mechanism assembly; the shoulder abduction counterweight mechanism assembly includes a shoulder abduction counterweight block and a shoulder abduction counterweight rope as well as a vertical guide rail, a horizontal guide rail supporting member, a horizontal guide rail, a counterweight turntable wire rope connecting member, a counterweight turntable wire rope and a shoulder abduction counterweight turntable disposed on the mechanical arm coupling member;

the horizontal guide rail is fixed to the sliding block of the vertical guide rail by the horizontal guide rail supporting member; the counterweight turntable wire rope has one end fixed to a sliding block of the horizontal guide rail by the counterweight turntable wire rope connecting member and the other end fixed to the shoulder abduction counterweight turntable; the shoulder abduction counterweight turntable is configured to fixedly connect the mechanical arm and is rotatable around the mechanical arm coupling member with the mechanical arm; the shoulder abduction counterweight rope has one end hung with the shoulder abduction counterweight block for the counterweight, and the other end fixed to the horizontal guide rail supporting member.

3. The upper limb exoskeleton rehabilitation device with man-machine motion matching and side-to-side interchanging of claim 2, characterized in that the shoulder girdle rotation shaft, the upper rotation joint rotation shaft and the lower rotation joint rotation shaft are hollow rotation shafts; the shoulder abduction counterweight rope passes through the shoulder girdle rotation shaft, the upper rotation joint rotation shaft and the lower rotation joint rotation shaft in sequence, and then is fixed to the horizontal guide rail supporting member; the shoulder abduction counterweight rope is guided by guide pulleys in the travelling path.

4. The upper limb exoskeleton rehabilitation device with man-machine motion matching and side-to-side interchanging of claim 2, characterized in that the shoulder abduction counterweight mechanism assembly further includes a shoulder abduction counterweight guide groove; the end of the shoulder abduction counterweight rope hung with the shoulder abduction counterweight block is guided by fixed pulleys and then enters the frame, with a shoulder abduction counterweight guide groove hung terminally;

the chassis bracket assembly is provided with a guide rod matched with the shoulder abduction counterweight guide groove for limiting the lifting path of the shoulder abduction counterweight guide groove.

5. An upper limb exoskeleton rehabilitation device with man-machine motion matching and side-to-side interchanging for man-machine motion matching and side-to-side interchanging of a mechanical arm, characterized by comprising: a chassis bracket assembly, a shoulder girdle abduction assembly, a side-to-side interchanging assembly and a mechanical arm coupling member;

the chassis bracket assembly includes a frame and a lifting unit mounted on the frame;

the shoulder girdle abduction assembly includes a shoulder girdle rotation joint and a shoulder girdle translation joint; the shoulder girdle rotation joint includes a shoulder girdle upper rotation joint, a shoulder girdle rotation shaft, a shoulder girdle lower rotation joint and steel tubes; the shoulder girdle upper rotation joint and the shoulder girdle lower rotation joint are coupled by the shoulder girdle rotation shaft and are rotatable around the shoulder girdle rotation shaft; the shoulder girdle upper rotation joint is mounted on the lifting unit to be driven by the lifting unit to move up and down;

the side-to-side interchanging assembly includes an interchanging assembly upper rotation joint, an upper locking assembly, an interchanging assembly lower rotation joint and a lower locking assembly; the interchanging assembly upper rotation joint includes an upper rotation joint supporting member and an upper rotation joint rotation shaft; the upper locking assembly is configured to lock and release the upper rotation joint rotation shaft; the lower rotation joint includes a lower rotation joint supporting member and a lower rotation joint rotation shaft; the lower locking assembly is configured to lock and release the lower rotation joint rotation shaft;

the upper rotation joint supporting member is mounted on the steel tubes, the upper rotation joint rotation shaft is rotatably mounted on the upper rotation joint supporting member, and the lower rotation joint supporting member is fixedly mounted on the upper rotation joint rotation shaft; the lower rotation joint rotation shaft is rotatably mounted on the lower rotation joint supporting member, the mechanical arm coupling member is fixedly coupled to the lower rotation joint rotation shaft, and the mechanical arm coupling member is configured to mount the mechanical arm and drive the mechanical arm to rotate with the respective rotating joints, thereby achieving the man-machine motion matching and side-to-side interchanging of the mechanical arm;

wherein the lifting unit includes an active lifting mechanism and a passive lifting mechanism; the passive lifting mechanism includes a passive lifting support plate, a passive lifting polish rod and a passive lifting platform; the passive lifting support plate is mounted on the active lifting mechanism to move up and down with the active lifting mechanism, the passive lifting polish rod is fixed to the passive lifting support plate, and the passive lifting platform is movable up and down along the passive lifting polish rod;

a mechanical arm overall counterweight block and a mechanical arm overall counterweight wire rope are further provided on the frame; the mechanical arm overall counterweight wire rope has one end fixed to the passive lifting platform and the other end hung with the mechanical arm overall counterweight block for the counterweight after being guided by fixed pulleys, thereby achieving passive up-and-down movement.

* * * * *